US005628558A

United States Patent [19]

Iacono et al.

[11] Patent Number: 5,628,558

[45] Date of Patent: May 13, 1997

[54] PNEUMATIC LANDSCAPE LIGHT

[76] Inventors: James L. Iacono, 65 Pinehill Rd.; Nils L. Reed, 379 Summer St., both of Lynnfield, Mass. 01940

[21] Appl. No.: 593,826

[22] Filed: Jan. 30, 1996

[51] Int. Cl.[6] ..... F21V 19/02

[52] U.S. Cl. ..... 362/288; 362/153.1; 362/431

[58] Field of Search ..... 362/288, 285, 362/153.1, 267, 431, 403

[56] References Cited

U.S. PATENT DOCUMENTS

| | | | |
|---|---|---|---|
| 4,180,850 | 12/1979 | Bivens | 362/285 |
| 4,272,802 | 6/1981 | Steadman | 362/403 |
| 4,300,186 | 11/1981 | Hurd | 362/385 |
| 4,974,134 | 11/1990 | Bourne | 362/286 |
| 4,984,139 | 1/1991 | Goggia | 362/153.1 |
| 5,003,441 | 3/1991 | Crowe et al. | 362/183 |
| 5,068,773 | 11/1991 | Toth | 362/386 |
| 5,072,345 | 12/1991 | Goggia | 362/153.1 |
| 5,072,811 | 12/1991 | Everhard | 92/52 |
| 5,075,834 | 12/1991 | Puglisi | 362/386 |
| 5,124,902 | 6/1992 | Puglisi | 362/386 |
| 5,130,916 | 7/1992 | Toth | 362/386 |
| 5,142,463 | 8/1992 | Panagotacos et al. | 362/285 |
| 5,144,542 | 9/1992 | Puglisi | 362/386 |
| 5,432,691 | 7/1995 | Garret et al. | 362/233 |

*Primary Examiner*—Ira S. Lazarus
*Assistant Examiner*—Alfred Basichas
*Attorney, Agent, or Firm*—O'Connell Law Firm

[57] ABSTRACT

An in-ground, pneumatically-operated, extensible-and-retractable landscape light comprised of an elongated outer housing having an air inlet in its body and an opening in its upper end into which is received in a telescoping, mating relationship an elongated inner housing which has a light source operably connected to the upper end thereof. The light source may be comprised of a light bulb and a source of electrical power, and the light source may be sheltered by an interchangeable light source sheltering unit. In use, the injection of air into the outer housing through the air inlet raises the inner housing from its retracted position to its extended position. The inner housing may be selectively locked in its extended position by a locking mechanism such as a solenoid with a solenoid plunger attached to one housing and a notch for receiving the plunger in the other housing.

13 Claims, 3 Drawing Sheets

PNEUMATIC LANDSCAPE LIGHT

FIELD OF THE INVENTION

The present invention relates to a device for providing illumination. More particularly, it relates to a pneumatically raised extensible and retractable landscape light.

BACKGROUND OF THE INVENTION

It has become commonplace for landowners to light their properties with in-ground landscape lights. Typically, the lights are installed in a series along driveways, walkways, and other areas sought to be lighted. In use, landscape lights provide pleasant illumination which improves the safety, appearance, and security of properties which employ them.

However, landscape lights serve no useful purpose in daylight. Furthermore, during daylight hours many consider the lights as marring the appearance of the well kept lawns on which they are situated. Also, it is during daylight hours when the lights are unnecessary that people are likely to be working or playing outdoors, and the lights present potentially dangerous obstacles to trip over or fall on. In addition, landscape lights act as highly undesirable obstacles to those seeking to maintain the lawn. Of course, the problems which upstanding lights present to people are supplemented by the problems which people present to the lights in the form of damage and inadvertent movement.

Fortunately, the prior art includes landscape lights which have the ability of selectively telescoping between an extended position above the ground for providing illumination and a retracted position level with the ground for avoiding obtrusiveness. Sundry means have been disclosed for extending and retracting the lighted portion of such landscape lights. For example, there have been landscape lights raised by complex gearing arrangements, lights raised by solenoids, and even lights raised by springs which are selectively deformable by the manipulation of temperature. These lights have been complex, expensive, prone to mechanical trouble, and difficult to repair.

Such inventive lights appear to have descended from the Bivens' "Retractable Light Fixture," found in U.S. Pat. No. 4,180,850. That patent discloses a telescoping landscape light hydraulically raised by water. Although laudable for its relative simplicity, the Bivens light left a multiplicity of problems which subsequent inventors have attempted to correct. The most notable problem is the tendency of water to freeze. In addition to rendering the lighting system completely inoperable, water's freezing within the light device or the hoses leading thereto could cause severe and permanent damage to the system.

Considering the above-described state of the art, one sees that the relatively simple, hydraulically raised landscape lights have limited applicability in cooler climates while the more universally applicable lights are undesirably complex. In light of the above, it becomes clear that there is a real need for an extensible and retractable landscape light which combines simplicity of design and durability of use with universal functionality.

SUMMARY OF THE INVENTION

Advantageously, the present invention has as its principal objective and result the providing of an extensible and retractable landscape light which is simple in construction, flexible in application, and durable in use. The invention's further object is to provide a landscape light which has interchangeable light sheltering units to allow for the selective modification of the device's appearance and the adaptation of the character, direction, and/or volume of the emitted light. These and other objects and advantages of this inventive landscape light will become obvious from a review of the ensuing discussion and the included figures.

In accomplishing the aforementioned objects, the present invention provides an in-ground, pneumatically-operated, extensible-and-retractable landscape light. The light is comprised essentially of an elongated outer housing having an inlet for air in its body and an opening in its upper end into which is received in a telescoping, mating relationship an elongated inner housing which has a light source operably connected to the upper end thereof. In this, the most basic form of the invention, there is described a landscape light which meets the needs left by the prior art by providing a landscape light which is simple, durable, and universally functional.

In a preferred embodiment of the pneumatically-raised light, the outer and inner housings are concentric cylinders. For ensuring that air injected into the interior of the outer cylinder through the air inlet raises the inner cylinder, there may be provided an O-ring disposed on the exterior surface of the inner cylinder for creating a generally airtight relationship between the two cylinders. There may be provided further a means for biasing the interior housing toward its retracted position such as a spring attached at one end to the outer cylinder and at a second end to the inner cylinder. To obviate the need for constant air injection into the outer cylinder, there also may be provided a means for selectively locking the housing in its extended position such as a locking solenoid plunger on one housing acting in cooperation with a receiving notch on the other housing. For rendering the landscape lights still more adaptable to varied applications, they may be provided with a detachably-connected, interchangeable light source sheltering unit. By use of the detachable and interchangeable light sheltering unit, it is contemplated that the landscape light may be adapted to emit light of differing direction, character, and/or volume.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION OF THE PREFERRED EMBODIMENT

As with many inventions, the broad nature of the present invention can lend itself to many different forms. However, to enable the proper practice of the invention and an understanding of the significance thereof, this portion of the specification shall set forth the means found most preferable for pneumatically raising a landscape light.

Figure 1:
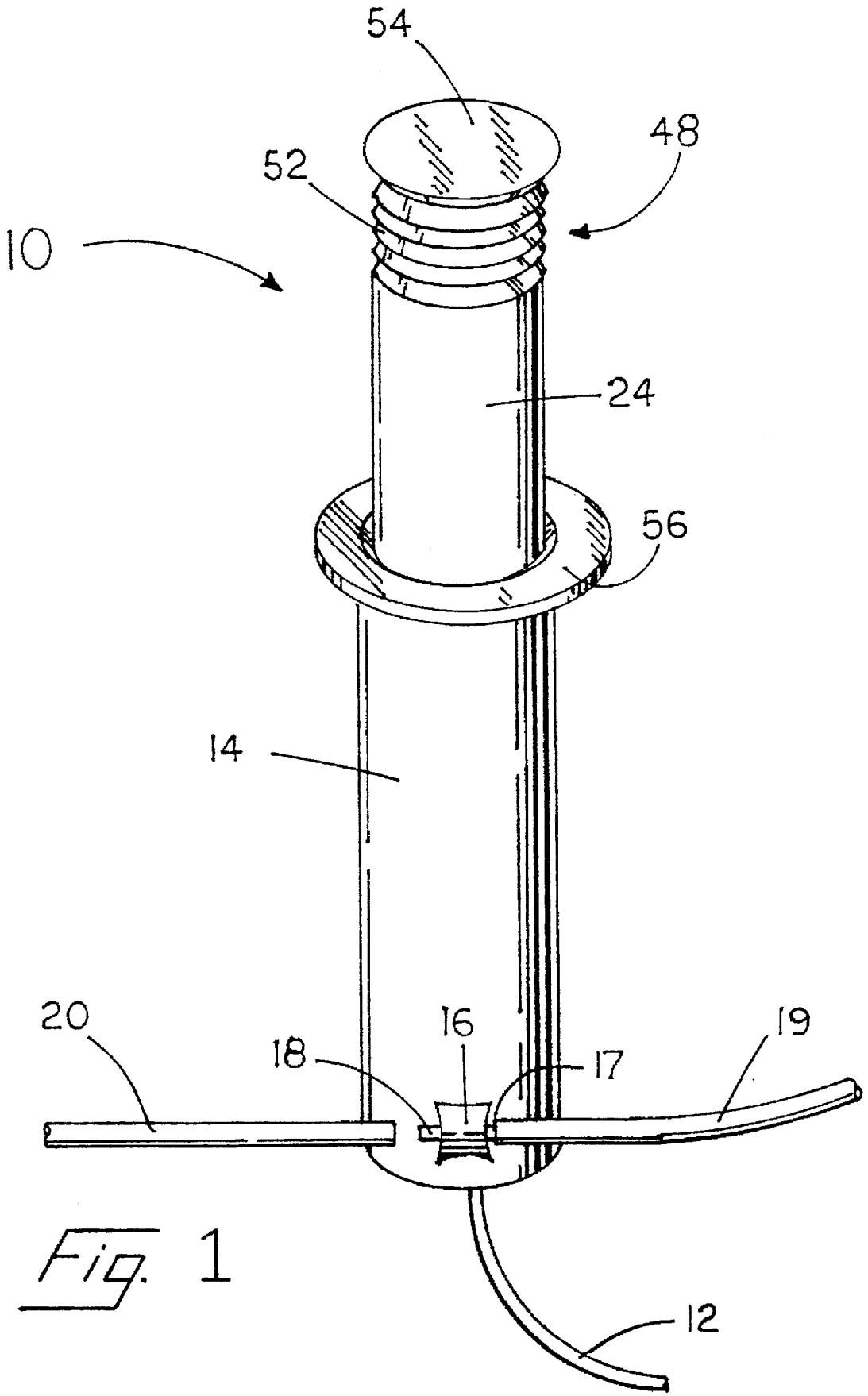
FIG. 1 is a perspective view of a pneumatic landscape light embodying the present invention with its interior housing in its extended position.
Figure 2:
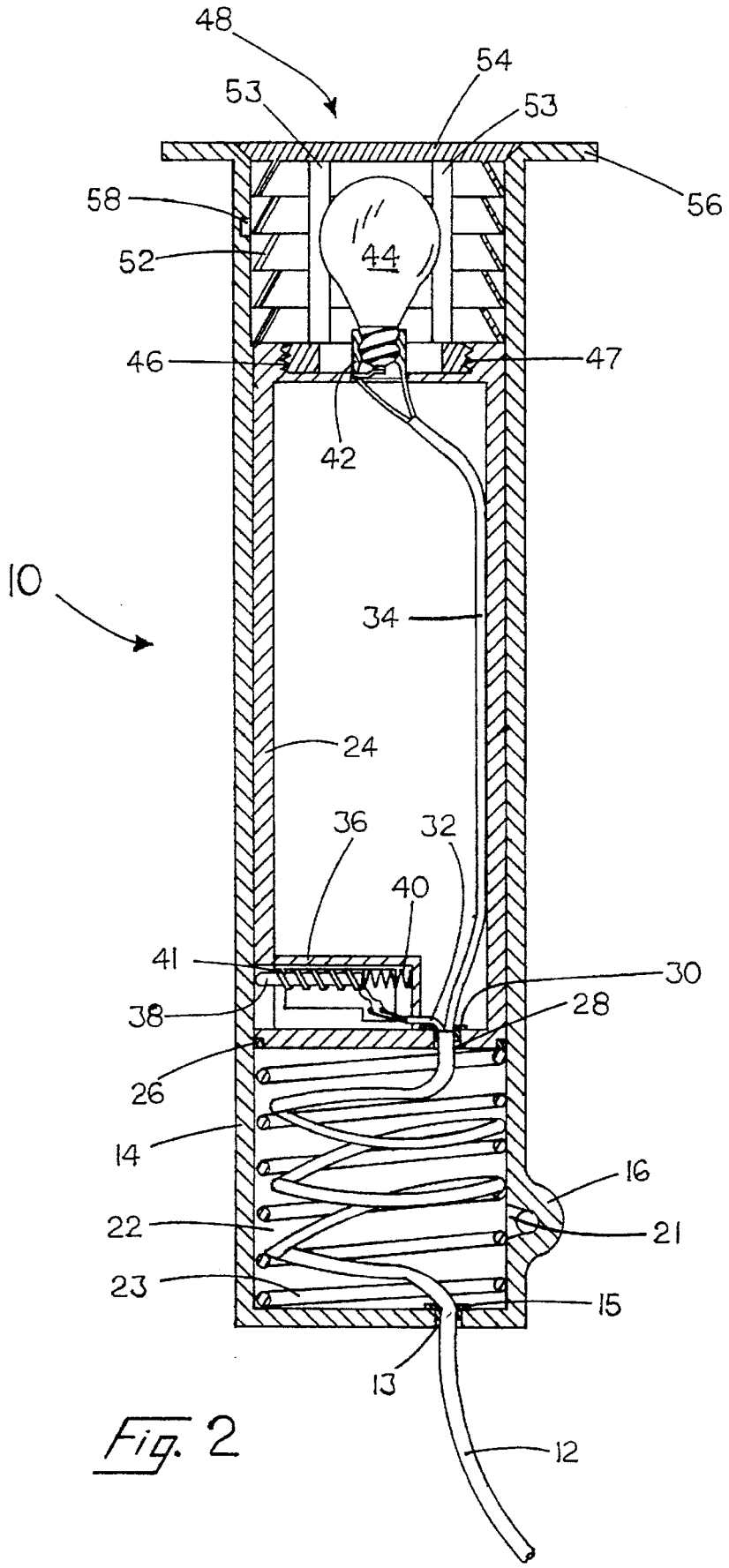
FIG. 2 is a sectioned elevational view of the pneumatic landscape light of FIG. 1 in its retracted position.

In the first figure, a pneumatic landscape light 10 embodying the present invention is shown in an extended position. FIG. 2 complements FIG. 1 in that it shows a sectional view of the same pneumatic landscape light 10 in a retracted position. Most generally, the device shown comprises an elongated outer housing cylinder 14 which receives a slightly smaller, elongated inner housing cylinder 24 in a freely telescoping, mating relationship. The outer housing 14 has a lower end, an upper end with an opening therein, an inner surface, and an outer surface. Likewise, the inner housing 24 has a lower end, an upper end, an inner surface, and an outer surface.

In practice, the pneumatic landscape light 10 is buried so that the upper end of the outer housing 14 is level with the ground's surface. The inner cylinder 24 is driven upward from that level by the force of air which is injected into the outer cylinder 14 through an air inlet 16. Atop the inner cylinder 24 is detachably connected a light source sheltering unit 48 which shelters a light source which includes a light bulb 44. The bulb 44 sheds light on the surrounding landscape when the pneumatic landscape light 10 is in use.

Figure 3:
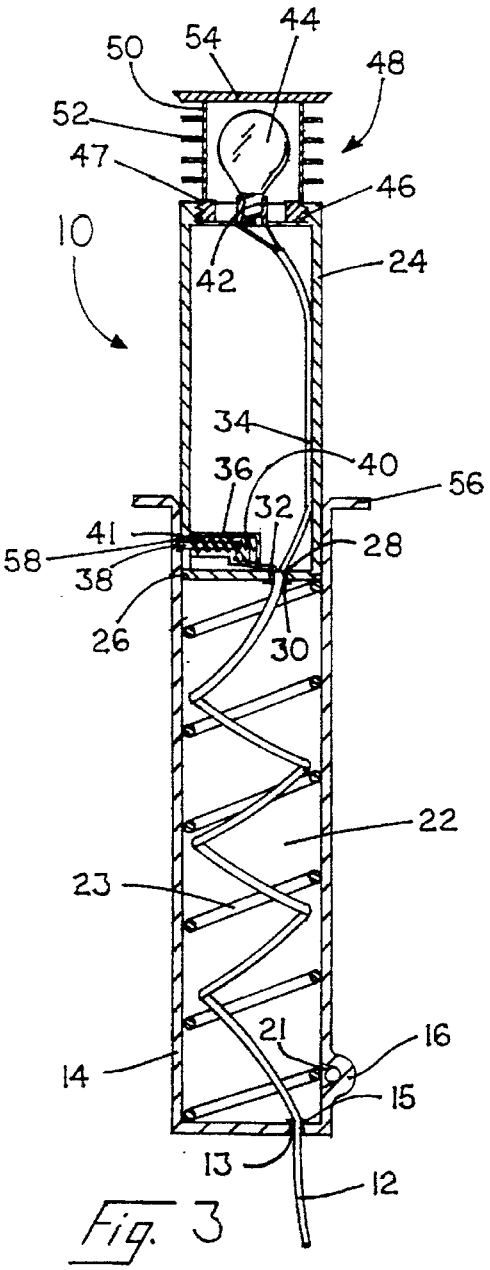
FIG. 3 is a sectioned elevational view of a pneumatic landscape light embodying the present invention in its extended position and with an alternative light source sheltering unit.

Referring more particularly to FIGS. 2 and 3, one sees that in this most preferred embodiment electrical power is supplied to the system by a unitary power cord 12. The cord 12 extends from a power source (not shown)and into the base of the cylindrical outer housing 14 through a power cord hole 13. From the base of the outer housing 14, the power cord 12 coils its way up to and through a power cord hole 28 in the base of the cylindrical inner housing 24. Upon passing through the hole 28, the unitary power cord 12 divides into its component parts which are the solenoid power cord 32 and the light source power cord 34. The solenoid power cord 32 proceeds into the solenoid 36 to which it is operably connected. The light source power cord 34 travels substantially the entire height of the inner housing 24 to the light bulb socket 42 to which it is operably connected. The electrical system is completed by light bulb 44 which screws into socket 42.

The pneumatic system by which the inner housing 24 is raised begins in the lower portion of the side wall of the outer housing 14 where there is an air inlet 16. The air inlet 16 has first and second nozzles 17 and 18 projecting from opposite sides thereof. The nozzles 17 and 18 are adapted for mating with first and second hoses 19 and 20. In FIG. 1, first hose 19 is shown properly mated with first nozzle 17. Second hose 20 is shown slightly distanced from nozzle 18 for greater clarity. In practice, second nozzle 18 would be mated with second hose 20, and the unseen end of second hose 20 would continue on to supply air to another pneumatic landscape light. Alternatively, if no landscape light were to follow the light 10 in a multi-light series, second nozzle 18 may be plugged to render that orifice generally airtight.

When the pneumatic light 10 is fully connected, the air inlet 16 acts as a conduit for air's passing from the air hose 19, through a duct 21 in the wall of the outer housing 14, and into a tubular substantially airtight chamber 22. This chamber 22 is defined by the base of the outer housing 14 which acts as its bottom, the cylindrical wall of the outer housing 14 which comprises its annular side wall, and the base of the inner housing 24 which constitutes its top. The chamber 22 is made generally airtight by means of a plug 15 in power cord hole 13, a plug 30 in power cord hole 28, and a flexible O-ring 26 surrounding an annular notch in the base of the inner housing 24.

As one might expect, the airtight character of each chamber 22 in a series of landscape lights will cause any addition of air to the system to tend to increase the air pressure therein. At a certain pressure, the air will force the telescoping inner cylinder 24 upward above its original ground-level position against the force of gravity and the biasing force of a helical tension spring 23 which is fastened at a first end to the base of the outer cylinder 14 and at a second end to the base of the inner cylinder 24.

The extending of the inner cylinder 24 necessarily raises the light source sheltering unit 48 which is detachably secured to the top of the inner cylinder 24. To allow simple detaching of the light sheltering unit 48, it is threadably engaged with the upper end of the inner cylinder 24 by threads 47 on the light sheltering unit 48 and corresponding threads 46 on the upper end of the inner cylinder 24. As the light sheltering unit 48 is raised, a beveled cap 54 which serves as the durable top of the unit 48 separates from a correspondingly beveled annular ridge 56 which encircles the uppermost end of the outer cylinder 14 and which remains generally level with the surrounding landscape. The continued pumping of air into the chamber 22 will raise the inner housing 24 to its fully extended position as is shown in FIG. 3.

Although it is conceivable that the inner housing 24 may be held in its extended position by a constant influx of air, it may be more practical and economical to employ a means for latching the inner housing 24 in its extended position. Such a latching means would permit the air supply to the landscape light 10 to be turned off once the inner housing 24 is raised fully. In this most preferred embodiment, the latching means is comprised of the solenoid 36 which is contained in the inner housing 24.

Referring to FIGS. 2 and 3, one sees that there is a solenoid locking plunger 38 which is biased to ride against the longitudinally communicating inner wall surface of the outer housing 14 by a helical locking compression spring 40. The plunger 38 is encircled by a solenoid coil of insulated wire 41 which may be selectively energized by solenoid power cord 32 which is operably connected to the solenoid coil 41. Once the inner housing 24 reaches its fully extended position, the locking plunger 38 will align with a locking plunger receiving notch 58. At that point, the locking plunger 38 will be urged into the receiving notch 58 by the locking spring 40 to lock the inner housing 24 in its fully extended position. Under this arrangement, it becomes no longer necessary to pump air into the system once all landscape lights in the series have been so raised and locked into position,.

When light is no longer necessary or desired, one may want to lower the light 10 to its unobtrusive, retracted position. To do so, the solenoid coil 41 may be energized by use of the solenoid power cord 32. By electromagnetic force, the coil 41 will draw the plunger 38 out of the receiving notch 58 despite the biasing effect of the spring 40. With the plunger 38 no longer holding the inner housing 24 in a raised position, the inner housing 24 will lower to its retracted position under the combined forces of gravity and the tension spring 23 as the system's contained air is exhausted back to and out of the source from which it came.

Figure 4:
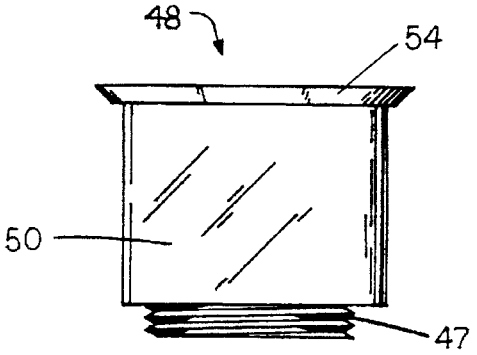
FIG. 4 is another alternative light source sheltering unit shown apart from the landscape light.
Figure 5:
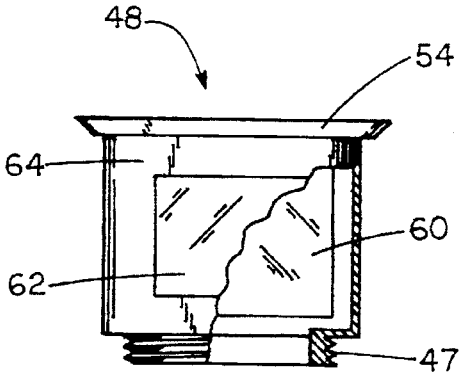
FIG. 5 is still another alternative light source sheltering unit which is partially sectioned and is shown apart from the landscape light.

As one may note, the style of light sheltering unit 48 is different in each of the second, third, fourth, and fifth figures. These variations are calculated to emphasize the simple interchangeability of the sheltering units 48. The threaded connection between each sheltering unit 48 and the inner housing 24 allows the landscape light 10 to be modified with respect to its appearance and the character, direction, and/or volume of light emitted. For example, light may be directed generally downward as in FIGS. 1 and 2 wherein the light sheltering unit 48 has a series of angularly disposed annular fins 52 supported by posts 53. In such an arrangement, the posts 53 are intended to leave the character of light substantially unaffected while the fins 52 are intended to restrict the direction of emitted light to a generally downward direction. Similarly, in FIG. 3 annular fins 52 encircle an annular translucent wall 50. However, in that figure, the fins 52 are flat so that light is directed generally outwardly. Another possible version of the sheltering unit 48 is shown in FIG. 4 wherein the fins found in the other figures are omitted altogether so that light emission is substantially unaffected in character, direction, or volume. FIG. 5 shows yet another variation of the sheltering unit 48 wherein light is directed in a selected direction to the exclusion of all other directions. This is accomplished by the providing of an annular opaque wall 64 which is designed to surround the light bulb 44, a translucent window 62 in the wall 64, and a reflective material 60 disposed on the inner surface of the wall 64 opposite the window 62. As one can surmise, there are many possible variations of the interchangeable sheltering units 48. This simple interchangeability allows a user to quickly and conveniently modify the essential character of a landscape light 10 embodying the present invention by twisting off a given sheltering unit 48 and replacing it with another.

From the foregoing, it is apparent that the present invention has many advantages. For example, by employing pneumatic technology, the light is made simpler, more durable, and more universally functional. The simplicity and durability of the invention are improved further by locating a locking solenoid within the inner cylinder to lock the device in a fully raised position. The light is improved still more by providing two air nozzles on each light to make the installation of a series of lights simpler. Still another advantage is gained by the invention's providing interchangeable light sheltering units to allow a user to customize or alter a given light without any need for purchasing a completely new light structure or even removing the device from the ground.

Although this description has set forth some most preferred embodiments of a pneumatically raised landscape light, one must note that other manifestations of the invention are possible without departure from the essential characteristics described above and claimed below. The preferred embodiments should be considered as illustrative rather than restrictive, and the protection afforded by this patent shall be restricted only by the spirit and scope of the claims which follow.

We claim as deserving the protection of United States Letters Patent:

1. An in-ground, pneumatically-operated, extensible and retractable landscape light comprising:

a) an elongated outer housing adapted to be at least partially buried in a surrounding volume of ground, the outer housing having an upper end with an opening therein, a lower end, an inner surface, and an outer surface;

b) an elongated inner housing having an upper end a lower end, and an outer surface the inner housing being received into the opening in the upper end of the outer housing in a telescoping, mating relationship and being at least partially within the outer housing when in a retracted position and projecting at least partially outside the outer housing when in an extended position;

c) an inlet in the outer housing for allowing air to be injected into the outer housing for pneumatically forcing the inner housing to an extended position; and d) a light source operably connected to the elongated inner housing for illuminating an area of landscape surrounding the light.

2. The pneumatic landscape light of claim 1 wherein the inner and outer housings are cylinders and the inner housing is disposed generally concentrically within the outer housing.

3. The pneumatic landscape of claim 1 further comprising a means for biasing the inner housing toward the retracted position of the inner housing.

4. The pneumatic landscape light of claim 3 wherein the biasing means is a spring.

5. The pneumatic landscape light of claim 2 further comprising a an O-ring encircling the inner housing for creating a substantially airtight seal between the inner housing and the outer housing.

6. An in-ground, pneumatically-operated, extensible and retractable landscape light comprising:

a) an elongated outer housing adapted to be at least partially buried in a surrounding volume of ground, the outer housing having an upper end with an opening therein, a lower end, an inner surface. and an outer surface;

b) an elongated inner housing having an upper end and a lower end, the inner housing being received into the opening in the upper end of the outer housing in a telescoping, mating relationship and being at least partially within the outer housing when in a retracted position and projecting at least partially outside the outer housing when in an extended position;

c) an inlet in the outer housing for allowing air to be injected into the outer housing for pneumatically forcing the inner housing to an extended position;

d) a light source operably connected to the elongated inner housing for illuminating an area of landscape surrounding the light; and e) a means secured to the light for selectively locking the inner housing in the extended position of the inner housing whereby the inner housing may be held in an extended position without a constant influx of pressurized air when the locking means is activated, and the inner housing may be allowed to retract when the locking means is deactivated.

7. The pneumatic landscape light of claim 6 wherein the locking means is comprised of a selectively energized solenoid secured to the inner housing which includes a solenoid coil and a locking plunger biased to ride against the inner surface of the outer housing, and a receiving notch in the inner surface of the outer housing for receiving the locking plunger wherein the locking plunger and the receiving notch are disposed to align when the inner housing is in an extended position whereby the locking plunger enters the receiving notch when the inner housing is extended to lock the inner housing in an extended position and the inner housing may be freed to retract by an energization of the solenoid coil to draw the plunger out of the receiving notch.

8. The pneumatic landscape light of claim 6 wherein the locking means is comprised of a selectively energized solenoid secured to the outer housing which includes a solenoid coil and a locking plunger biased to ride against the outer surface of the inner housing, and a receiving notch in the outer surface of the inner housing for receiving the locking plunger wherein the locking plunger and the receiving notch are disposed to align when the inner housing is in an extended position whereby the locking plunger enters the receiving notch when the inner housing is extended to lock the inner housing in an extended position and the inner housing may be freed to retract by an energization of the solenoid coil to draw the plunger out of the receiving notch.

9. The pneumatic landscape light of claim 6 wherein the light source is located in the upper end of the inner housing, and the upper end of the inner housing has a light sheltering unit attached thereto with at least a portion of the light sheltering unit being formed of a translucent material for allowing the light source to illuminate a surrounding landscape.

10. The pneumatic landscape light of claim 9 wherein the light sheltering unit is detachable from the inner housing whereby it may selectively removed and replaced.

11. The pneumatic landscape light of claim 10 wherein the light sheltering unit is detachable by means of compatible threads disposed on the light sheltering unit and the inner housing whereby the two are detachably connected in a threaded relationship.

12. The pneumatic landscape light of claim 9 wherein the light source is comprised of a light bulb and a source of electrical power.

13. The pneumatic landscape light of claim 12 wherein the electrical power source is comprised of electrical wiring extending from a main source of electricity to and into the inner housing where it is operably connected to the light bulb.

* * * * *